US006326919B1

(12) United States Patent
Diximus et al.

(10) Patent No.: US 6,326,919 B1
(45) Date of Patent: Dec. 4, 2001

(54) PATCH ANTENNA

(75) Inventors: Frédéric Diximus, Dole; Daniel Leclerc, Crissey; Roland Vincent, Dole, all of (FR)

(73) Assignee: Amphenol Socapex (FR)

( * ) Notice: Subject to any disclaimer, the term of this patent is extended or adjusted under 35 U.S.C. 154(b) by 0 days.

(21) Appl. No.: 09/446,901

(22) PCT Filed: May 4, 1999

(86) PCT No.: PCT/FR99/01051

§ 371 Date: Jan. 3, 2000

§ 102(e) Date: Jan. 3, 2000

(87) PCT Pub. No.: WO99/57785

PCT Pub. Date: Nov. 11, 1999

(30) Foreign Application Priority Data

May 5, 1998 (FR) ..... 98 05656
Mar. 11, 1999 (FR) ..... 99 02989

(51) Int. Cl.[7] ..... H01Q 1/36

(52) U.S. Cl. ..... 343/700 MS; 343/702; 343/846

(58) Field of Search ..... 343/700 MS, 702, 343/790, 791, 846, 872

(56) References Cited

U.S. PATENT DOCUMENTS 4,724,443 * 2/1988 Nysen ..... 343/700 MS
5,019,829 * 5/1991 Heckman et al. ..... 343/700 MS
5,450,090 * 9/1995 Gels et al. ..... 343/700 MS
5,734,350 3/1998 Deming et al. .
6,002,367 * 12/1999 Engblom et al. ..... 343/700 MS

FOREIGN PATENT DOCUMENTS 0 630 069 12/1994 (EP) ..... H01Q/13/08
97/44856 11/1997 (WO) ..... H01Q/9/04

* cited by examiner

*Primary Examiner*—Don Wong
*Assistant Examiner*—Shih-Chao Chen
(74) *Attorney, Agent, or Firm*—Blank Rome Comisky & McCauley, LLP

(57) ABSTRACT

The invention relates to an internal antenna element of the patch type for a portable device. The element comprises a body of dielectric material, a conductive plate covering the top face of the dielectric, and a conductive strip covering one of the side faces of the dielectric, the strip being electrically connected along its top edge to one of the edges of said plate and being provided with electrical connection means for connecting said conductive strip to a ground plane that is to be placed against the bottom face of the dielectric body, the other three side faces having no metallization, means passing through the dielectric body for electrically connecting the hot point of an antenna conductor to said plate, and capacitor-forming means for providing capacitance between the plate and the ground plane when the antenna element is mounted on the ground plane, and located close to the side face of the dielectric body that is remote from its side face covered by said conductive strip.

17 Claims, 4 Drawing Sheets

PATCH ANTENNA

BACKGROUND OF THE INVENTION

Field of the Invention

The present invention relates to patch type antennas, and particularly but not exclusively to antennas suitable for use in portable radiotelephones.

Portable radiotelephones are presently becoming very widespread in numerous countries. One of the objects sought by the designers of such radiotelephones is to make them as small as possible so as to make them even more easy to use. One of the elements that gives rise to difficulties with such miniaturization is the antenna of the radiotelephone. In the vast majority of conventional radiotelephones, the antenna is external and therefore increases the overall size of the device.

Another problem associated with designing radiotelephones lies in the fact that two frequency bands are used at present for portable radiotelephone networks. Firstly there is the so-called "GSM" band which corresponds to frequencies in the range 890 MHz to 960 MHz, and secondly there is the so-called "DCS 1800" frequency band which extends from 1700 MHz to 1880 MHz.

It will therefore be advantageous to have radio-telephones capable of operating in either of those two frequency bands depending on the network being used.

It is relatively easy to provide electronic circuits in a radiotelephone that are capable of processing transmission and reception of signals corresponding to two different frequency bands, and typically those that are mentioned above. In contrast, designing an antenna that is suitable for two frequency bands constitutes a problem that is more difficult.

Patch type antennas have already been proposed for use in radiotelephones. Such an antenna can be placed inside the radiotelephone itself, thereby considerably reducing its overall size. Nevertheless, in that known solution, the patch antenna is suitable for operating in one frequency band only.

There thus exists a real need for an antenna of the patch type which is suitable in particular for portable telephones and which is capable of operating in two distinct frequency bands, and in particular in the above-mentioned frequency bands.

SUMMARY OF THE INVENTION

An object of the present invention is thus to provide an antenna element or a complete antenna of the patch type which is capable of operating in two distinct frequency bands and which is suitable for fitting to a portable device.

According to the invention, this object is achieved by a patch-type internal antenna element for a portable device, which antenna element is characterized in that it comprises:

- a body of dielectric material having a bottom face, a top face, and four side faces;
- a conductive plate covering said top face;
- a conductive strip covering one of the side faces, electrically connected along its top edge to one of the edges of said plate, and provided with electrical connection means extending along a second edge parallel to its top edge and designed to connect said conductive plate to a ground plane that is designed to be placed against the bottom face of said dielectric body, the other three side faces having no metallization;

- means passing through said dielectric body between its bottom face and its top face, for electrically connecting the hot point of an antenna conductor to said plate; and
- capacitor-forming means for providing capacitance between said plate and said ground plane when said antenna element is mounted on the ground plane, said means being located close to the side face of the dielectric body that is remote from its face covered by said conductive strip, whereby the side face remote from the face provided with said strip forms a radiating slot corresponding to a first frequency band while the other two opposite side faces that are not covered in metallization form radiating slots for a second frequency band.

It will be understood that because of the presence firstly of the radiating slot corresponding to a short circuit and secondly of the other two radiating slot faces, it is possible to use the antenna in two distinct frequency bands as required, corresponding respectively to half-wavelength and to quarter wavelength.

It will also be understood that because of the presence of the capacitance, good tuning is obtained between the antenna conductor or probe and the antenna itself in both of the frequency bands in which the antenna can operate.

The invention also provides an internal patch type antenna for a portable device, which antenna is characterized in that it comprises an antenna element of the above-defined type, a conductive plate constituting the ground plane, and a power supply whose hot point is connected to said plate and whose power supply ground is connected to the conductive plate forming the ground plane of the antenna.

It will thus be understood that it is easy using the antenna element to provide a complete antenna by adding a ground plane.

In a variant embodiment of the antenna, the conductive antenna plate and the conductive strip covering one of the side faces to the dielectric belonging to the antenna element, and also the conductive plate constituting the ground plane, are all constituted by a single folded metal sheet that is fixed to the body of dielectric material.

In a preferred embodiment of this variant, the portion of said metal sheet that forms the ground plane has a first opening surrounded by an electrical connection collar that projects from said sheet and that constitutes an extension of said sheet, and the hot point is constituted by a conductor element passing through the body of dielectric material and having a first end electrically connected to said antenna plate and having a second end projecting from the face of the dielectric material inside said collar.

It will be understood that in this embodiment, the collar and the second end of the conductor element form antenna connection elements that are directly suitable for co-operating with a base provided on the printed circuit of the portable device fitted with the antenna.

In numerous cases, the portable device which is fitted with its internal patch antenna must also be capable of operating with an external antenna, e.g. the antenna of a motor vehicle. Under such circumstances, it is necessary for the internal antenna to be disconnected from the antenna circuit of the portable device and for the external antenna to be connected instead to the antenna circuit of the device.

To solve this problem, in an embodiment that can be combined with the preceding embodiment, the antenna is characterized in that the portion of said metal sheet that forms said antenna plate has a second opening in register with the first opening, in that the first end of said conductor element projects from the top face of said body of dielectric material, in that said body of dielectric material has a recess surrounding said conductor element, and in that said sheet includes an elastically deformable second extension surrounding said second opening with the free end thereof projecting into said recess and being pressed resiliently against said conductor element.

It will be understood that the elastically deformable second extension constitutes an electric switch member. At rest, corresponding to the device operating with the internal antenna, the conductor element is electrically connected to the conductive plate forming the radiating patch of the patch antenna via the switch element. Otherwise, when the external antenna connector is connected, said connector moves away the switch element forming second extension of the conductor element, thereby disconnecting the internal antenna.

The invention also relates to the use of an internal antenna of the patch type for a portable device and of the above-defined type in making a portable radio-telephone, the use being characterized in that the conductive plate forming the ground plane is constituted by the ground plane for the circuits of the radio-telephone.

In addition, said conductive plate is preferably interposed between the printed circuit of the radio-telephone and the antenna element so that said conductive plate forms a reflector plane for the antenna, thereby providing directivity and thus protecting the user against electromagnetic radiation.

Other characteristics and advantages of the invention will appear better on reading the following description of various embodiments of the invention that are given by way of non-limiting example. The description refers to the accompanying drawings,

BRIEF DESCRIPTION OF THE FIGURES OF DRAWINGS

Figure 2:
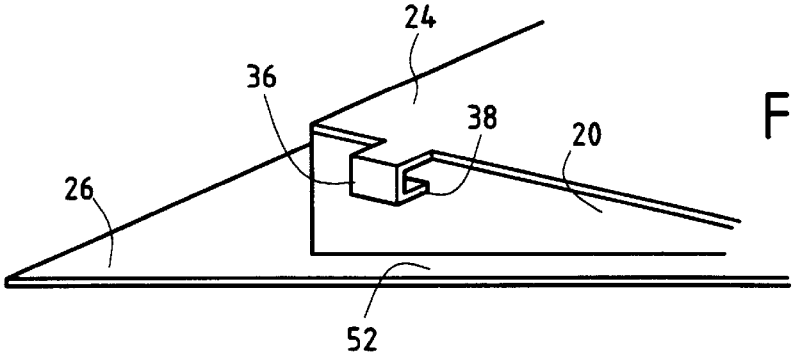
FIG. 2 is a detail view showing a first embodiment of the antenna capacitor.
Figure 2A:
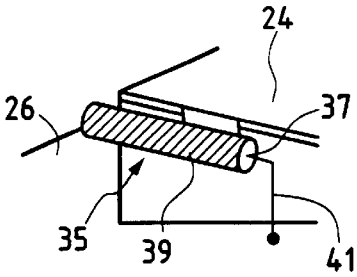
Figure 3:
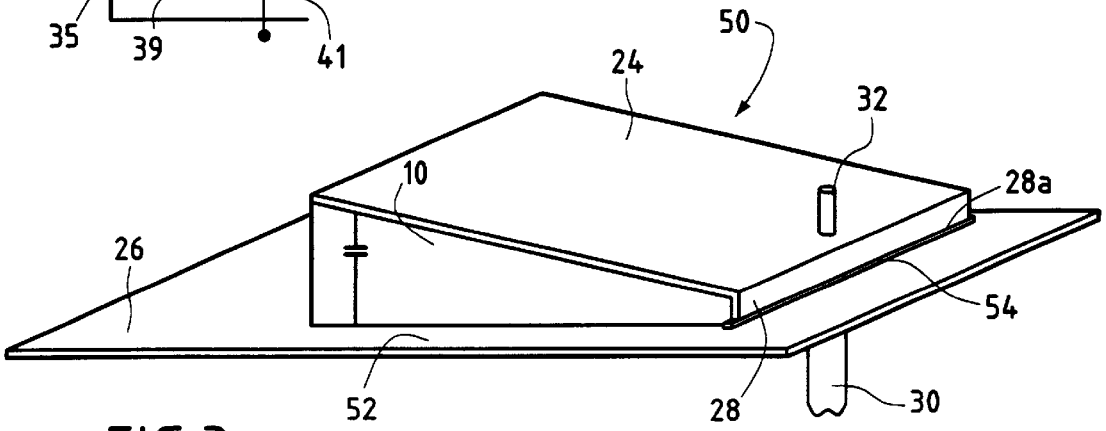
Figure 4:
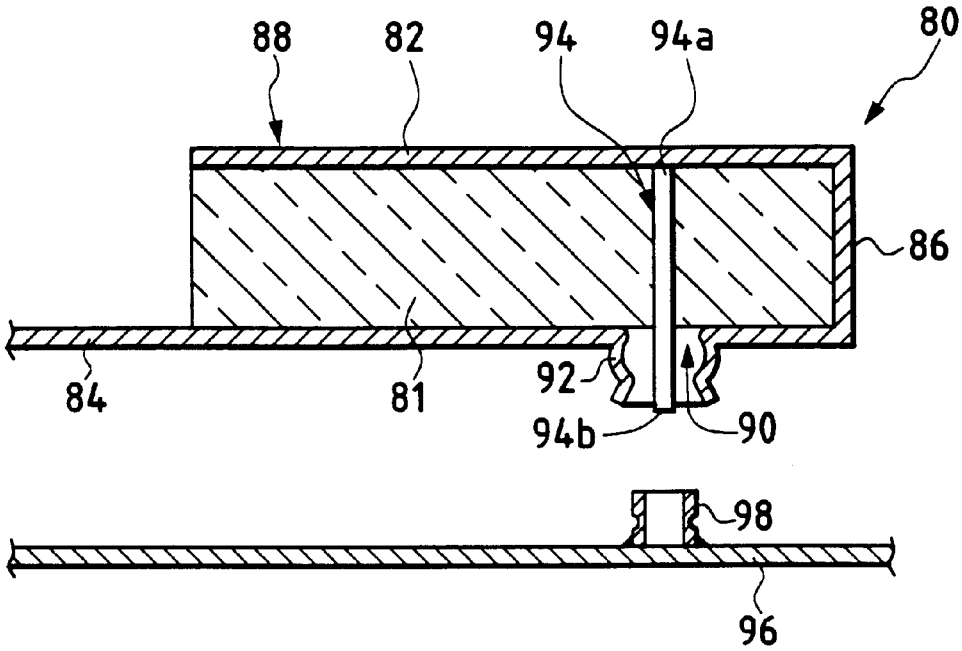
Figure 5:
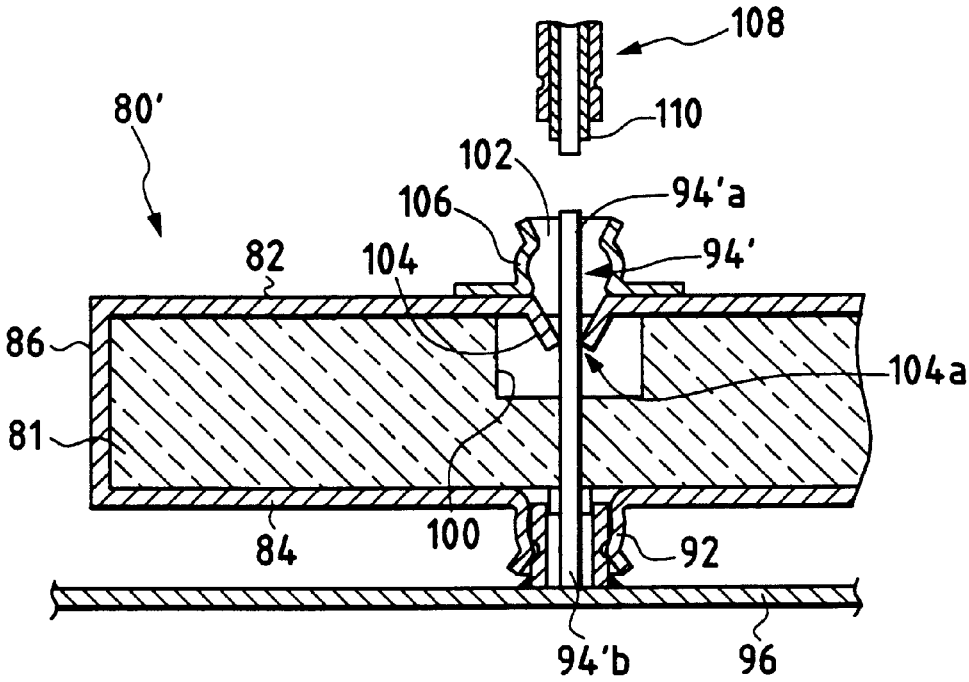
Figure 6A:
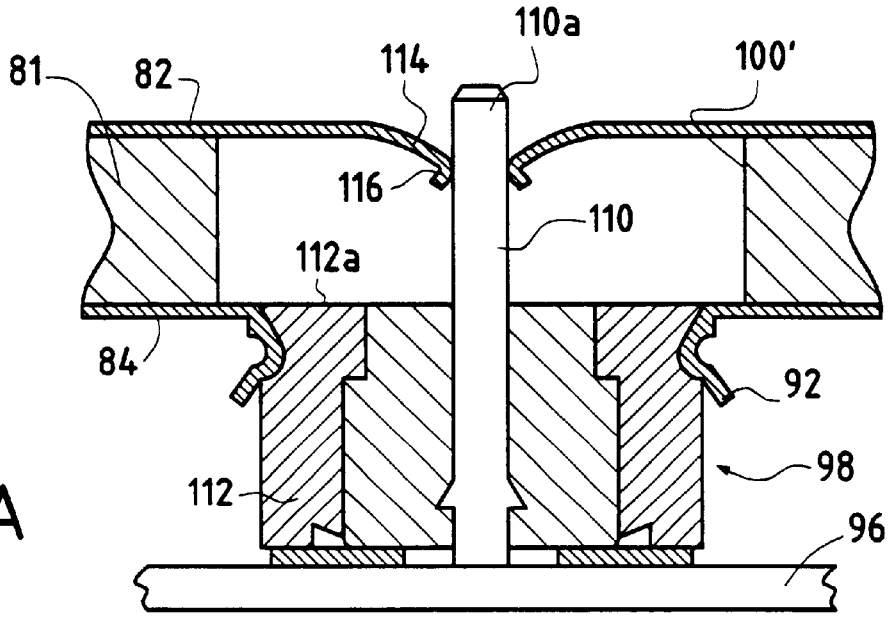
Figure 6B:
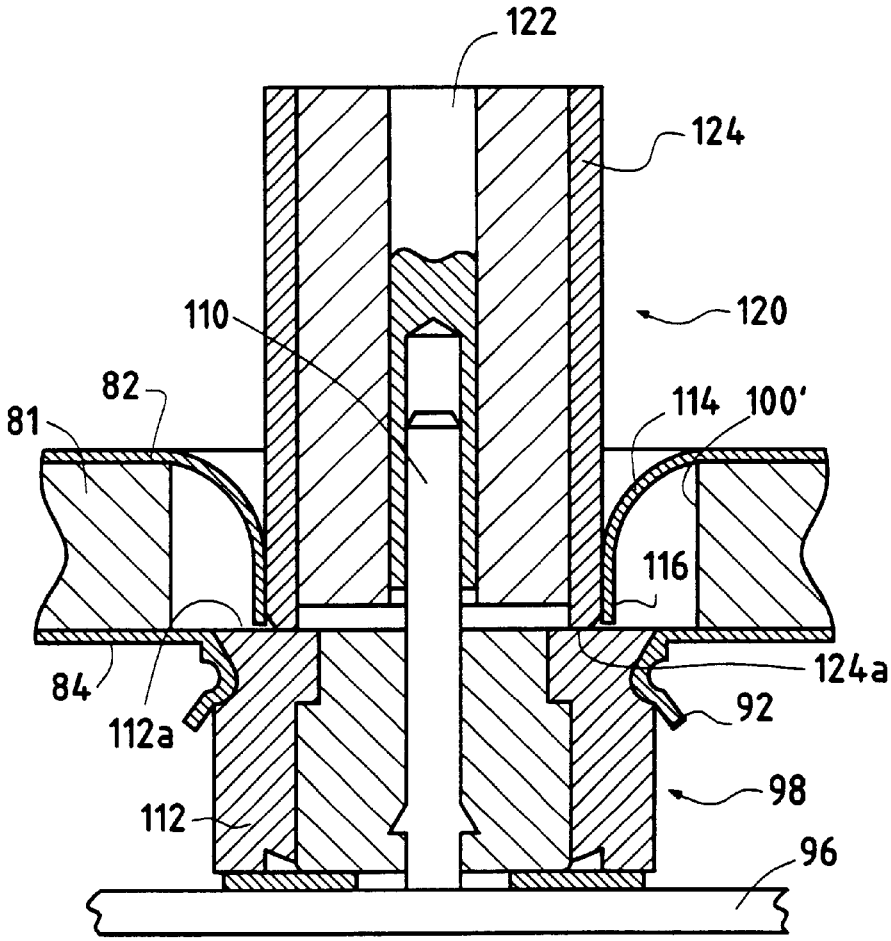
Figure 7:
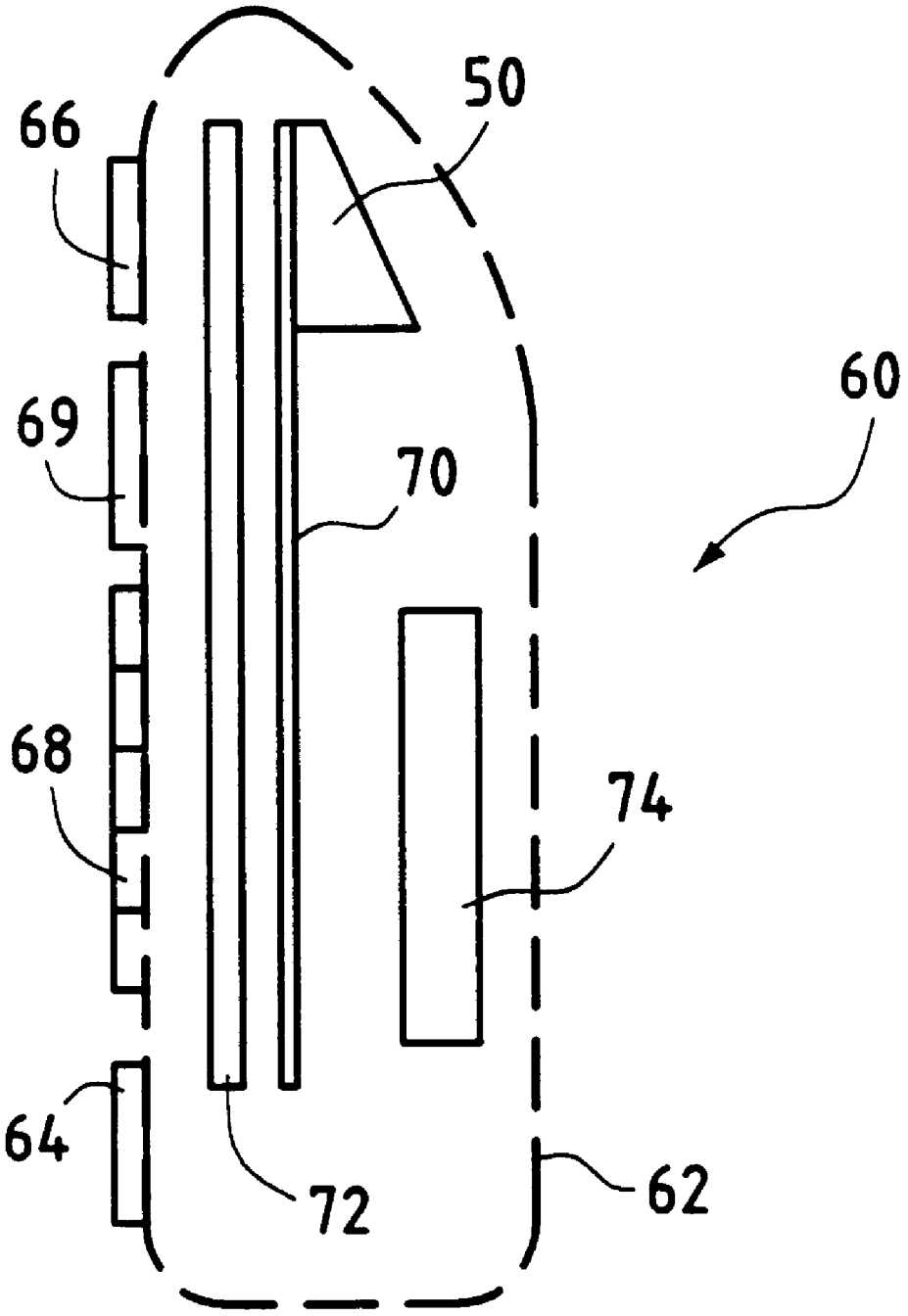

FIG. 2*a* is a view showing a variant embodiment of the capacitor;

FIG. 3 is a perspective view showing one way in which the antenna element can be mounted on the ground plane;

FIG. 4 is a diagrammatic vertical section view of a patch antenna fitted with an antenna connector;

FIG. 5 is a diagrammatic vertical section view of a patch antenna fitted with an antenna connector and with an external antenna switch;

FIGS. 6*a* and 6*b* show a preferred embodiment of the antenna shown diagrammatically in FIG. 5; and FIG. 7 is a diagrammatic view showing how an antenna is positioned in a radiotelephone.

DETAILED DESCRIPTION OF THE PREFERRED EMBODIMENTS

Figure 1:
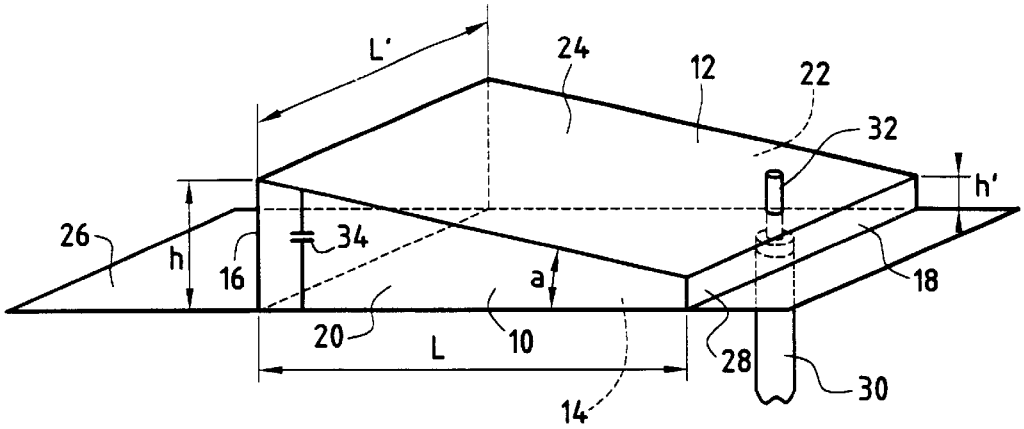
FIG. 1 is a perspective view showing the principle on which the patch antenna is based.

With reference initially to FIG. 1, there follows a description of the overall structure of the patch antenna of the invention. As shown in FIG. 1, the antenna comprises a block 10 of dielectric material having a top face 12, a bottom face 14, and four side faces that are parallel in pairs, respectively comprising faces 16 and 18 and faces 20 and 22. In the embodiment shown in FIG. 1, the top and bottom faces 12 and 14 form between them a dihedral angle $\alpha$, which dihedral angle lies in the range 0 to 45° and preferably in the range 0 to 25°. The top face 12 of the dielectric block 10 is covered in a conductive layer of metallization 24 thus forming a conductive plate, and the bottom face 14 rests on a conductive plate 26 forming a ground plane. The face 18 is also covered by metallization 28 which is electrically connected to the ground plane 26 and to the conductive plate 24, thus forming a short circuit strip. In contrast, the side faces 20, 22, and 16 have no metallization. The antenna also has a feed conductor or probe 30 having both a hot point 32 connected to the conductive plate 24 and ground connected to the ground plane 26. In the example described, the feed conductor is in the form of a coaxial conductor, however other embodiments could be envisaged. The feed to the antenna 30 is preferably located close to the face 18 that has the short circuit strip 28, and close to the side face 22. The antenna also has a capacitor represented symbolically at 34, electrically connecting the ground plane 26 to the conductive plate 24. This capacitor 34 is preferably located close to the side face 20 and to the side face 16. In other words, it can be said that the capacitor 34 is diagonally opposite the antenna feed 30.

The patch antenna made in this way can operate in two frequency bands defined respectively by the radiating slots constituted by the side faces 20 and 22, and by the side face 16 that is remote from the short circuit strip 28. If the length of the faces 20 and 22 is written L and the length of the face 16 remote from the short circuit is written L', it will be understood that the radiating slot 16 corresponds to a frequency band for which one-quarter of the wavelength is substantially equal to L, while the slots 20 and 22 make it possible to operate in a frequency band for which one-half of the wavelength is substantially equal to the length L'.

It should also be added that in order to ensure that the above-described antenna is tuned to operate in both of these frequency bands, it is necessary to provide the capacitor 34 which performs tuning.

The dielectric material constituting the block 10 preferably has a relative permittivity $\epsilon_r=6$ and a loss angle whose tangent is equal to $10^{-4}$. A suitable material is a ceramic.

When the two frequency bands are those that are mentioned above, i.e. the GSM band and the DCS 1800 band, the lengths L and L' can be equal to 3 cm. The height h of the radiating slot 16 is equal to 5 mm, and the height h' of the short circuit is equal to 2 mm.

It should be added that the conductive plate 24 and the short circuit strip 28 can be made either in the form of conductive plates that are fixed to the corresponding faces of the dielectric block 10, or else by metallization formed on said faces. The ground plane 26 is constituted by a conductive plate.

This provides an antenna element constituted by the dielectric body and the areas of metallization 24 and 28, and also the capacitor 34 which together constitute a self-contained component. It suffices to fix it on the base plate to provide a patch antenna.

With reference to FIG. 2, a preferred embodiment of the capacitor 34 is described. The capacitor is constituted by an extension 36 of the conductive plate 24, said extension having a curved portion 38 which is thus parallel to the face 20 of the dielectric block. The curved end 38 is set apart from the face 20 and terminates above the ground plane 26 in the form of a portion extending towards the side face of the block 10 of dielectric material.

It will be understood that this embodiment of the capacitor is particularly advantageous since it requires no special component. Nevertheless, the capacitor 34 could be constituted by a conventional capacitor electrically connected to the conductive plate 24 and to the ground plane 26.

FIG. 2*a* shows another embodiment of the capacitor 34 which in this case is adjustable. The capacitor is constituted by a piece of coaxial cable 35 having an axial conductor 37 and a cylindrical conductor 39. The cylindrical conductor 39 is electrically connected to the plate 24, while the end of the axial conductor 37 is connected to the ground plane 26 via a conductor wire 41. By modifying the length of the cable 35 by means of successive cuts, it is possible to tune the capacitance of the capacitor 24 accurately.

When the antenna is mounted in a radiotelephone, it can be advantageous for the antenna ground plane to be constituted by the ground plane for the electronic circuits of the radiotelephone. Under such circumstances, the antenna proper is the result of uniting an antenna element 50 and a conductive ground plate 52 by fixing the antenna element thereto. In this case, the antenna element 50 comprises the above-described dielectric block 10, the conductive plate 24, and the short circuit strip 28. To provide electrical continuity when the antenna element 50 is mounted on the plate 52, it is advantageous to provide a compressible conductive gasket 54 along the bottom edge 28*a* of the short circuit strip 28 so as provide electrical contact when the antenna element is fixed on the plate 52.

FIG. 7 is a diagram showing how an antenna can be fixed within a radiotelephone 60. In this figure, there are shown in simplified manner: the housing 62 together with its microphone 64 and its earpiece 66. There are also shown the keypad 68 of the radiotelephone, and its display unit 69. Inside the housing 62 there are shown the ground plate 70 for the electronic circuit 72 of the radiotelephone and its battery 74. The plate 70 has the antenna element 50 shown in FIG. 3 mounted thereon.

It will be understood that the disposition of the antenna element is particularly advantageous since it is small in size, since it can use the ground plane of the radiotelephone circuit as the antenna ground plane, and since the antenna 50 which includes the ground plane 70 is located relative to the conductive plate 70 in such a manner that it constitutes a reflector plane for the antenna, thereby causing the electromagnetic radiation emitted by the antenna to be emitted in directional manner, thus protecting the user of the antenna.

With reference now to FIG. 4, there follows a description of a first variant embodiment of the antenna for the case where it is fitted with its own antenna connector. The antenna 80 comprises a body of dielectric material 81 of the same kind as that shown in FIGS. 1 to 3, a radiating top plate 82, a ground plane 84, and a short circuit strip 86 connecting the top plate 82 to the ground plane 84. As explained above, the short circuit strip 86 occupies only one of the four side faces of the body of dielectric material 81. In addition, the antenna has a capacitor 34 of the kind explained above, but not shown. In this embodiment, the radiating plate 82, the base plate 84, and the short circuit strip 86 are constituted by a single conductive sheet 88 which is folded and fixed to the corresponding faces of the body of dielectric material 81. The portion of the sheet that constitutes the base plate 84 is machined to define an opening 90 and a collar-forming extension 92 for electrical connection purposes. In addition, the axial antenna conductor 94 is constituted by a conductive rod having a first end 94*a* that is electrically connected to the plate 82 and a second end 94*b* that projects beyond the bottom face of the body 81 inside the volume defined by the collar 92. This figure also shows the printed circuit 96 of the portable device fitted with the antenna 80. In this figure, there can be seen the base 98 for making a link between the internal antenna 90 and the circuits of the portable device. It will be understood that in order to mount the antenna and to connect it, it suffices to engage the base 98 inside the collar 92 so as to connect the antenna to the printed circuit 96.

The extension 92 can be constituted by a deformed portion of the metal sheet or it can be constituted by a piece that is fitted thereto, being soldered to the metal sheet 88 around the opening 90.

With reference now to FIGS. 5, 6*a*, and 6*b*, a second variant embodiment of the antenna is described in which there is not only an internal antenna connector, but also a switching external antenna connector.

FIG. 5 shows the theoretical configuration of this antenna. There can be found the body of dielectric material 81, and the metal sheet 88 which constitutes the top radiating plate 82, the short circuit strip 86, and the ground plane 84. There can also be found the collar 92 forming the internal antenna connection and the conductive rod 94' which is equivalent to the rod 94 and whose end 94'*b* projects into the collar 92. In this embodiment, a recess 100 preferably surrounds a portion of the conductive rod 94' and the rod projects via its second end 94'*a* from the top face of the dielectric body 81. Machining is used in the top plate 82 to form a second opening 102 into which the end 94'*a* of the rod projects, and to constitute angled resilient tongues 104 whose free ends 104*a* press against the rod 94'. In addition, a second conductive collar 106 is fixed on the plate 82 and projects away therefrom to define an electrical connection collar for an external antenna 108. As can be seen in FIG. 5, the end 94'*a* of the rod 94' projects inside the second collar 106.

When the portable device is to operate with the internal antenna, which corresponds to FIG. 5, the conductive tongues 104 press against the rod 94' and its end 94'*a* is thus connected to the radiating plate 82. This reconstitutes the same electrical configuration as that shown in FIG. 4. However, when the external antenna connector 108 is engaged, its insulating portion 110 moves the conductive resilient tongues 104 away, thereby interrupting the electrical link between the plate 82 and the rod 94'. Nevertheless, antenna ground is connected to the ground of the printed circuit via collars 106 and 92, and the axial conductor of the antenna 108 is connected to the rod 94'.

It will be understood that the conductive resilient tongues 104 constitute an electrical switch which, at rest, enables the portable device to operate with the internal antenna 80' and which, when the external antenna connector is engaged, link the external antenna to the circuits 96 of the portable device.

In order to further improve the operation of the antenna, in particular in external antenna operation when the external antenna is connected to the patch antenna, it is preferable for the recess 100 to pass right through the dielectric body so that when the antenna connector 108 is mounted, the external conductor thereof is electrically connected to the external conductor of the base 98. In this way, the cylindrical electrical conductor which surrounds the axial conductor 94 eliminates or at least greatly reduces any risk of the patch antenna being excited by the external antenna which is then in operation.

Such coupling would have the effect of reducing the amount of energy available to the external antenna.

With reference now to FIGS. 6*a* and 6*b*, a preferred embodiment of the antenna shown diagrammatically in FIG. 5 is described in greater detail.

In this embodiment, the body of dielectric material 81 has a recess 100' passing right through it between the plate 82 and the ground plane 84. The ground plane 84 has an extension 92 in the form of a collar which constitutes the external connection for the base 98 which is fixed to the printed circuit 96. The base 98 is constituted by an external conductor 112 and by an axial conductor 110 which passes through the recess 100' and which projects beyond the plate 82.

In register with the recess 100', the plate 82 has an elastically deformable extension 114 that is generally frustoconical in shape. At rest, i.e. when the external antenna is not connected, the free edge 116 of the extension 114 is electrically in contact with the end 110*a* of the axial conductor 110. An electrical link is thus established between the antenna plate 82 and the printed circuit 96.

When it is desired to connect the external antenna by means of its antenna conductor 120, the conductor is inserted in the recess 100'. The central conductor 122 is then connected to the axial conductor 110. Its external conductor 124 deforms the extension 114 which then comes into electrical connection with the external conductor 124 of the antenna connector 120. In addition, the end 124*a* of the external conductor 124 of the antenna connector 120 comes into electrical contact with the end 112*a* of the external conductor 112 of the base 98. This provides an electrically conductive cylinder passing through the dielectric 81 and surrounding the axial conductors 110 and 122. Thus, when the external antenna is in operation, there is no coupling with the internal antenna constituted by the plate 82 and the ground plane 84.

What is claimed is:

1. An internal antenna element of the patch type for a portable device, the antenna element comprising:

a solid body of dielectric material having a bottom face, a top face, and four side faces;

a conductive plate covering and fixed to said top face;

a conductive strip covering and fixed to one of the side faces, electrically connected along its top edge to one of the edges of said plate, and provided with electrical connection means extending along a second edge parallel to its top edge and designated to connect said conductive plate to a ground plane that is designed to be placed against the bottom face of said dielectric body, the other three side faces having no metallization;

means passing through said dielectric body between its bottom face and its top face, for electrically connecting the hot point of an antenna conductor to said plate; and capacitor means for providing capacitance between said plate and said ground plane when said antenna element is mounted on the ground plane, said means being located close to an angle between two side faces of said body not covered by said conductive strip, whereby the side face remote from the face provided with said strip forms a radiating slot corresponding to a first frequency band while the other two opposite side faces that are not covered by conductive material form radiating slots for a second frequency band.

2. The antenna element according to claim 1, wherein said top and bottom faces of the dielectric body form a dihedral angle lying in the range 0 to 45°, with the side face covered by the conductive strip being of a height that is no greater than the height of the side face remote therefrom.

3. The element according to claim 2, wherein said dihedral angle lies in the range of 0 to 25°.

4. The antenna element according to claim 1, wherein the length of the dielectric body in the direction orthogonal to the conductive strip corresponds substantially to one-quarter of the wavelength of the first frequency band and wherein the length of said dielectric body corresponds substantially to one-half of the wavelength of the second frequency band.

5. The antenna element according to claim 1, wherein said capacitor means and said connecting means are disposed close to two non-adjacent edges of the dielectric body.

6. The antenna element according to claim 1, wherein said capacitor means comprise an extension of said conductive plate forming a plane surface extending parallel to one of the side faces of the dielectric body and of a length that is less than that of the facing portion of the side face.

7. The antenna element according to claim 1, wherein said capacitor means comprise a length of coaxial cable whose conductive elements are electrically connected to said plate and are connectable to the ground plane.

8. The antenna element according to claim 1, wherein said conductive plate and conductive strip are constituted by metallization on the corresponding faces of said dielectric body.

9. The antenna element according to claim 1, wherein said electrical connection means of the conductive strip comprise a strip of compressible conductive material.

10. An internal antenna of the patch type for a portable device, said internal antenna comprising:

a base conductive plate forming the ground plate of the antenna, a body of dielectric material having a bottom face, a top face and four side faces, said bottom face being fixed on said base conductive plate;

a conductive plate covering said top face;

a conductive strip covering one of said side faces and having a first edge electrically connected to said conductive plate and a second edge electrically connected to said base conductive plate, the three other side faces of said dielectric body having no metallization, a feed having a hot point and a ground conductor, said feed passing through said dielectric body between said bottom face and said top face, said hot point being connected to said conductive plate, and said ground conductor being connected to said base conductive plate; and capacitor means for providing capacitance between said conductive plate and said based conductive plate forming said ground plane, said means being located close to the side face of the dielectric body that is remote from its face covered by said conductive strip, whereby the side face remote for the face provided with said strip forms a radiating slot corresponding to a first frequency band while the other two opposite side faces that are not covered in metallization form radiating slots for a second frequency band.

11. The antenna according to claim 10, wherein the conductive plate covering the top face of the dielectric material belonging to the antenna element and the conductive strip covering one of the side faces of the dielectric material belonging to the antenna element, and the conductive plate constituting the ground plane, are all constituted by a single folded material sheet that is fixed to the body of dielectric material.

12. The antenna according to claim 11, wherein the portion of said metal sheet that forms the ground plane has a first opening surrounded by an electrical connection collar that projects from said sheet and that constitutes an extension of said sheet, and the hot point is constituted by a conductor element passing through the body of dielectric material and having a first end electrically connected to said antenna plate and having a second end projecting from the face of the dielectric material inside said collar.

13. The antenna according to claim 12, wherein the portion of said metal sheet that forms said conductive plate covering the top face of the dielectric material belonging to the antenna element has a second opening in register with the first opening, wherein the first end of said conductor element projects from the top face of said body of dielectric material, wherein said body of dielectric material has a recess surrounding said conductor element, and wherein said sheet includes an elastically deformable second extension surrounding said second opening with the free end thereof projecting into said recess and being pressed resiliently against said conductor element.

14. The antenna according to claim 13, wherein said recess passes right through said body of dielectric material and wherein said recess is suitable for receiving the connector for an external antenna.

15. The antenna according to claim 14, wherein said recess passes right through said body of dielectric material and in that said recess is suitable for receiving the connector for an external antenna.

16. A portable radio telephone comprising the internal antenna as claimed in claim 10, wherein the conductive plate forming the ground plane is constituted by the ground plate for the circuits of the radio telephone.

17. A portable radio telephone comprising the internal antenna as claimed in claim 10, wherein the ground plate of the antenna is located inside said radio telephone to constitute a reflector plate for the antenna, thus making the antenna directional and therefore providing the user with protection against electromagnetic radiation.

* * * * *